US009999802B2

(12) United States Patent
Kilmon

(10) Patent No.: US 9,999,802 B2
(45) Date of Patent: Jun. 19, 2018

(54) BODY WEIGHT EXERCISE ASSEMBLY CONFIGURED TO ACCEPT VARIOUS DISCIPLINE ATTACHMENTS

(71) Applicant: Donald Kilmon, Baltimore, MD (US)

(72) Inventor: Donald Kilmon, Baltimore, MD (US)

( * ) Notice: Subject to any disclaimer, the term of this patent is extended or adjusted under 35 U.S.C. 154(b) by 0 days. days.

(21) Appl. No.: 15/656,013

(22) Filed: Jul. 21, 2017

(65) Prior Publication Data

US 2018/0021626 A1 Jan. 25, 2018

Related U.S. Application Data

(60) Provisional application No. 62/365,840, filed on Jul. 22, 2016.

(51) Int. Cl.
*A63B 23/12* (2006.01)
*A63B 21/068* (2006.01)
*A63B 21/16* (2006.01)

(52) U.S. Cl.
CPC ..... *A63B 23/1218* (2013.01); *A63B 21/068* (2013.01); *A63B 21/1618* (2013.01)

(58) Field of Classification Search
CPC ..... A63B 21/1618; A63B 21/1627–21/1636; A63B 21/0023; A63B 21/068; A63B 21/169; A63B 21/4045; A63B 1/00; A63B 7/00–7/02; A63B 2208/0285; A63B 23/1218; A61G 7/1042; A61G 7/053; B60P 7/0815
See application file for complete search history.

(56) References Cited

U.S. PATENT DOCUMENTS 2,891,490 A * 6/1959 Elsner ..... B60P 7/0815 24/265 CD
4,749,188 A * 6/1988 Montgomery ..... A63B 21/0602 482/106
6,163,906 A * 12/2000 Kay ..... A61G 7/053 5/658
6,948,895 B2 * 9/2005 Buff ..... B60P 7/0815 410/102
7,540,831 B2 6/2009 Hauser
2012/0115684 A1 5/2012 Nguyen

OTHER PUBLICATIONS

YakAttack brand Tie-Downs. Available at: https://www.yakattack.us/AAP_1025_p/aap-1025.htm See also attached screen shots.

* cited by examiner

*Primary Examiner* — Loan H Thanh
*Assistant Examiner* — Jennifer M Deichl

(57) ABSTRACT

Disclosed is an exercise device having an elongated body, a slot formed length-wise in the body, the slot having an undercut portion on each side, a plurality of holes in slot for receiving one of a plurality of fasteners, an exercise accessory having a connecting member, and a head of the connecting member, the head sized to be received in the slot of the body and configured to be slidably retained in the slot. The slot can have undercut portions. The undercut portions can have locking features. The head of the connecting member can have complimentary locking features. A tightening member can fix the connecting member in a position in the slot. The elongated body can have a cutout for receiving the head of the connecting member.

11 Claims, 10 Drawing Sheets

BODY WEIGHT EXERCISE ASSEMBLY CONFIGURED TO ACCEPT VARIOUS DISCIPLINE ATTACHMENTS

This application is a non-provisional of, and claims the benefit of priority of, U.S. Provisional Application No. 62/365,840 filed Jul. 22, 2016, the entirety of which is hereby incorporated by reference.

BACKGROUND OF THE INVENTION

Field of the Invention

The embodiments of the invention relate to exercise equipment, and more particularly, to an exercise apparatus that can be mounted inside of a door frame. Although embodiments of the invention are suitable for a wide scope of applications, it is particularly suitable for body-weight exercises such as pull ups, chin ups, and other suspended-body exercises.

Discussion of the Related Art

The related art exercise systems include over-door-frame pull up bars. These related art pull up bars generally include a free-standing apparatus that is generally not attached to a door frame with a fastener. Instead, the related art pull up apparatus has a flat portion that rests against a trim portion of a door frame and a curved portion that hooks on to the top of a trim portion of the door. On such example is described in U.S. Pat. Pub. No. US20120115684 of Nguyen ("Nguyen"). As shown in FIG. 1, Nguyen discloses an elongated bar 49 with padded ends 42 and 41 that rest against an outside trim portion of a door. Nguyen further discloses curved portions 36 and 37 with padded securing portion 31 that rests on top of an inside trim portion of the door.

Another related art exercise system is disclosed in U.S. Pat. No. 7,540,831 to Hauser et. al. ("Hauser"). Hauser discloses, generally, a U-shaped frame that can be hingedly mounted in a door frame at either end. As shown in FIG. 2, the Hauser frame 256 can be secured in an up or down position by connecting the frame 256 at additional points to the door frame. The Hauser frame has a tubular cross-piece 205 to which a user can attached a variety of accessories such as handles 130, bars, and straps by hooking a hook-portion 110 of such accessory over the tubular cross-piece 205 of the frame.

The related art door-mounted exercise apparatuses, however, suffer from a variety of failings which limit the usefulness of such devices. For example, the Nguyen device has a cross bar that rests against an outside trim portion of a door frame. When weight is applied to the cross bar during normal use, the cross bar applies pressure against the trim. This pressure can cause unsightly damage to the outside faces of the trim. Also, with the Nguyen device, the door cannot be closed because the Nguyen device interferes with normal door operation. In another example, the Hauser patent discloses that accessories can attach to the cross bar with hooks. However, during vigorous use, the hooks can become disconnected from the crossbar and potentially cause falling injuries to the user.

SUMMARY OF THE INVENTION

Accordingly, embodiments of the invention are directed to a body weight exercise assembly configured to accept various discipline attachments that substantially obviates one or more of the problems due to limitations and disadvantages of the related art.

An object of embodiments of the invention is to provide a door-frame exercise apparatus that does not damage the outside faces of the door trim.

Another object of embodiments of the invention is to provide a door-frame exercise apparatus that can securely receive accessories.

Additional features and advantages of embodiments of the invention will be set forth in the description which follows, and in part will be apparent from the description, or may be learned by practice of embodiments of the invention. The objectives and other advantages of the embodiments of the invention will be realized and attained by the structure particularly pointed out in the written description and claims hereof as well as the appended drawings.

To achieve these and other advantages and in accordance with the purpose of embodiments of the invention, as embodied and broadly described, a body weight exercise assembly configured to accept various discipline attachments includes an elongated body, a slot formed length-wise in the body, the slot having an undercut portion on each side, a plurality of holes in slot for receiving one of a plurality of fasteners, an exercise accessory having a connecting member, and a head of the connecting member, the head sized to be received in the slot of the body and configured to be slidably retained in the slot. The slot can have undercut portions. The undercut portions can have locking features. The head of the connecting member can have complimentary locking features. A tightening member can fix the connecting member in a position in the slot. The elongated body can have a cutout for receiving the head of the connecting member.

In another embodiment, a body weight exercise assembly configured to accept various discipline attachments includes an elongated body having a top surface for attaching to a doorframe and a bottom surface, a T-slot formed length-wise in the bottom surface of the body, the T-slot having an undercut portion on each side, a plurality of holes in a bottom of the T-slot and extending to the top surface of the body, the plurality of holes for receiving one of a plurality of fasteners to fasten the body to the door frame, an exercise accessory having a connecting member, and a cutout the T-slot on the bottom surface of the body for receiving a head of the connecting member, the connecting member sized to be received in the T-slot of the body and configured to be slidably retained in the T-slot, wherein the T-slot extends between a first end and a second end of the body.

In yet another embodiment, a body weight exercise assembly configured to accept various discipline attachments includes an elongated body and a connector. The elongated body can include a top surface of the elongated body for connecting to the doorframe, a bottom surface of the elongated body, a slot formed in the elongated body, the slot extending from a first end of the elongated body to a second end of the elongated body, a first undercut portion formed on a first side of the slot, a second undercut portion formed on a second side of the slot, a locking structure formed on each of the first and second undercut portions, a first and second holes formed in a bottom of the slot and extending through to the top surface of the elongated body, each of the first and second holes for receiving a first and second fastener, respectively, a cutout in the bottom surface of the elongated body exposing a portion of the first and second undercut portions. The connector can be used for attaching an exercise accessory to the elongated body, the connector can include a head portion of the connector, the head portion sized in approximate proportion to be received in the cutout in the elongated body and slidably retained by the first and second undercuts of the slot, a mating locking structure configured to interface with the locking structure of the first and second undercuts, a shaft having a first end connected to the head, a spring on the shaft, and a tightening member connected to a second end of the shaft.

It is to be understood that both the foregoing general description and the following detailed description are exemplary and explanatory and are intended to provide further explanation of embodiments of the invention as claimed.

BRIEF DESCRIPTION OF THE DRAWINGS

The accompanying drawings, which are included to provide a further understanding of embodiments of the invention and are incorporated in and constitute a part of this specification, illustrate embodiments of the invention and together with the description serve to explain the principles of embodiments of the invention.

DETAILED DESCRIPTION OF THE PREFERRED EMBODIMENTS

Figure 1:
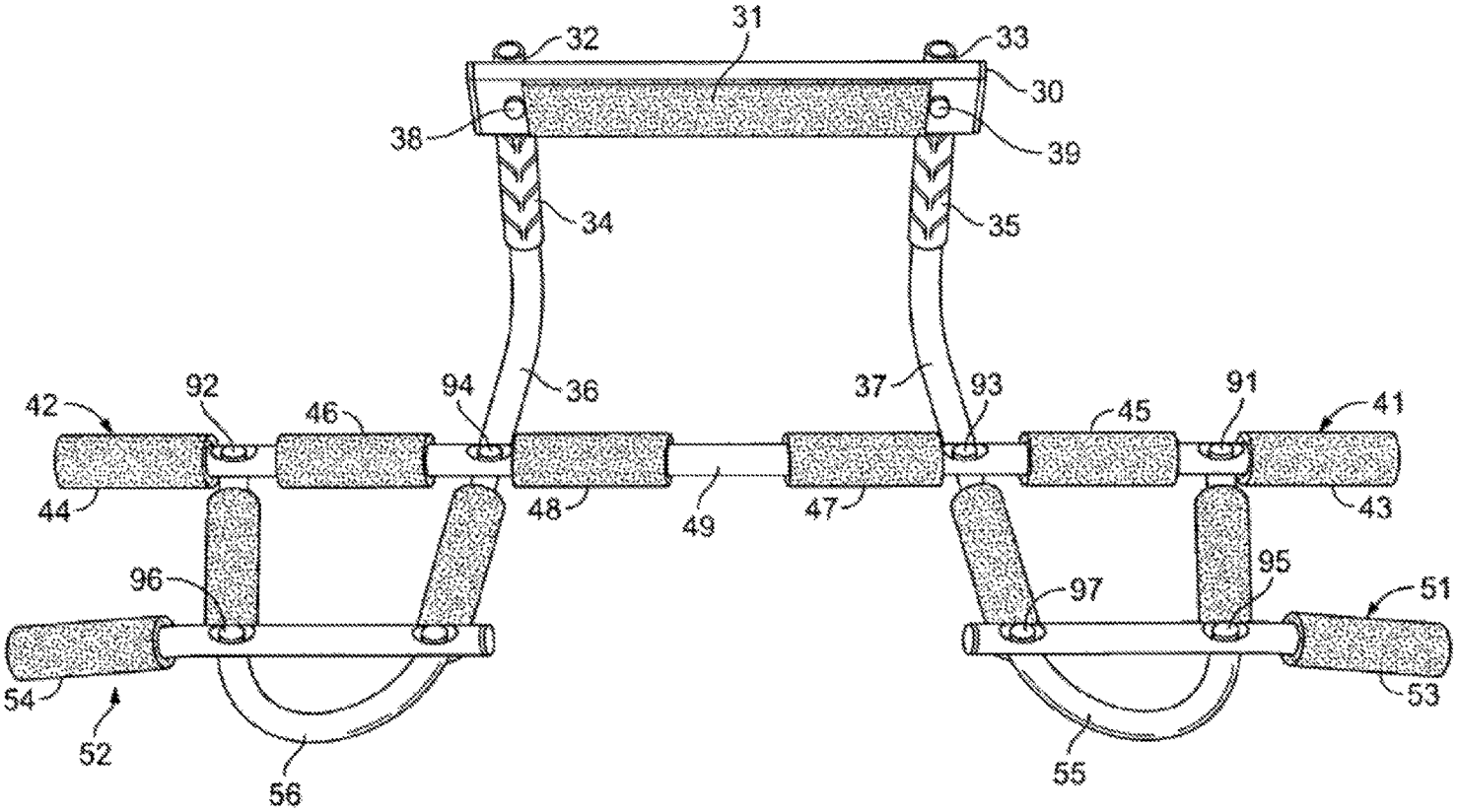
FIG. 1 PRIOR ART
FIG. 1 is an illustration of the related art according to Nguyen.
Figure 2:
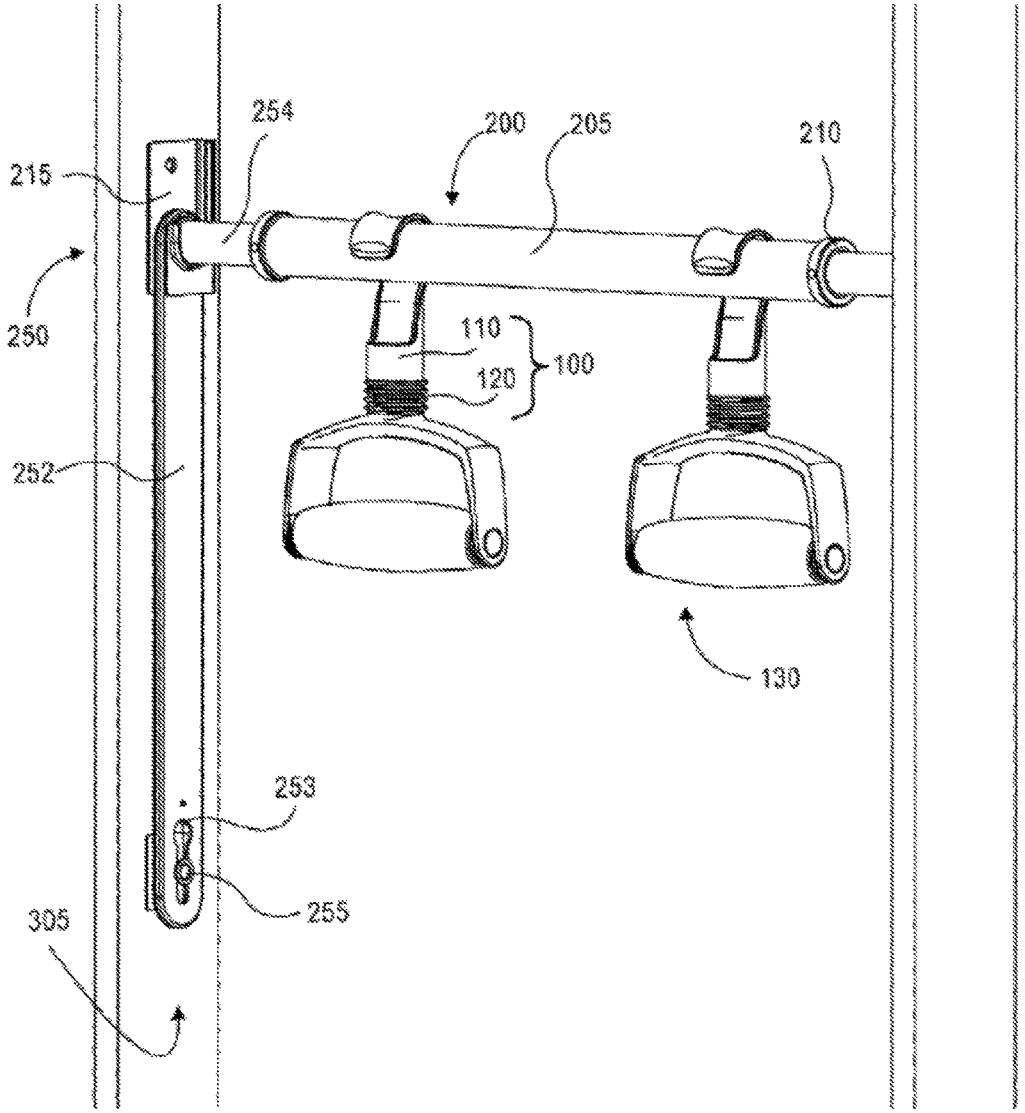
FIG. 2 PRIOR ART
FIG. 2 is an illustration of the related art according to Hauser.

Reference will now be made in detail to the preferred embodiments of the invention, examples of which are illustrated in the accompanying drawings. The invention may, however, be embodied in many different forms and should not be construed as being limited to the embodiments set forth herein; rather, these embodiments are provided so that this disclosure will be thorough and complete, and will fully convey the concept of the invention to those skilled in the art. In the drawings, the thicknesses of layers and regions are exaggerated for clarity. Like reference numerals in the drawings denote like elements.

Figure 3:
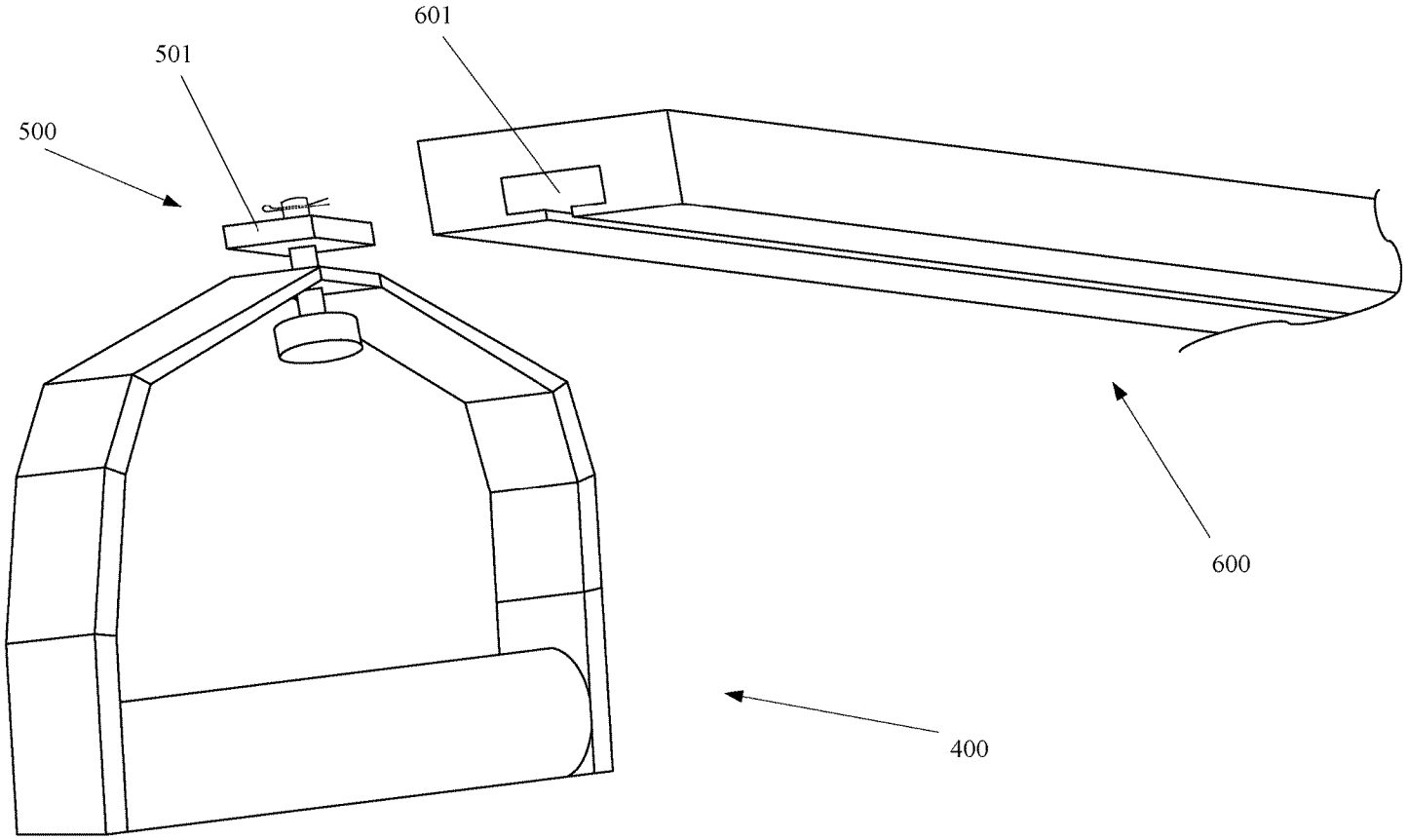
FIG. 3 is an isometric view of a body weight exercise device according to an exemplary embodiment of the invention.

FIG. 3 is an isometric view of a body weight exercise device according to an exemplary embodiment of the invention. As shown in FIG. 3, a body weight exercise device includes an elongated body that forms a track system 600 that can be mounted in a door frame (not shown). The track system 600 can include a slot 601 for receiving a similarly sized head 501 of a connecting member 500 of an exercise accessory 400.

The track 600 can be made in different lengths. The track 600 can be mounted in a door frame. The track 600 can also be mounted in other locations such as a ceiling, a desk, or a garage. The track can be formed from extruded aluminum. The track can be formed from folded sheet metal. The track can be formed from a resin, a composite, machined from solid material, injection molded plastic, or extruded plastic.

In preferred embodiments, the track 600 is 28" to 30" long so that it can fit in a standard door frame. The track 600 can be 2 inches wide. The track can have a slot 601 extending along the length of the track 600. The slot can be between ¼" wide or ½" wide or greater. The slot 601 can be shaped to receive the head 501 of a connector member 500 from an exercise accessory 400. One such accessory 400 is a handle accessory depicted in exemplary form in FIG. 3.

The slot 601 can extend for the length of the track 600. The slot 601 can be exposed and open to a left side and a right side of the track 600. While the pictures and drawings attached hereto show a track having one slot, it is contemplated that the invention could further have two slots or even three or more slots. A second slot could be slightly spaced apart from and parallel to the first slot 601. A third slot can be slightly spaced apart from and parallel to the first slot 601 and the second slot (not shown). The third slot can be perpendicular to the first slot.

The bolt head portion 501 of the connector member 500 of the handle accessory 400, can be introduced into the slot 601 of the track 600. The shape of the slot 601 can match the shape of the head 501 of the connector member 500 thereby allowing the head 501 to slide along the track 600, but not be pulled through when a user applies body weight to the accessory 400. In exemplary embodiments of the invention, the handle accessory 400 can be used for pull ups.

Although embodiments of the invention show and describe a head portion 501 of the connector member 500 of the handle accessory 400, alternatives embodiments of the connector 500 and head 501 are contemplated by this invention. In embodiments of the invention, the connector member is a threaded bolt, a head of the threaded bolt is sized to fit into the slot, and a nut is used to secure the exercise accessory to the bolt. In alternative embodiments of the invention, a stud can be welded to the exercise accessory. The stud can further have a cap to mimic the relative dimensions of the head 501. A connector member and head or a stud and cap can be described as a connecting member for slidably connecting the accessory to the slot of the track portion.

Figure 4:
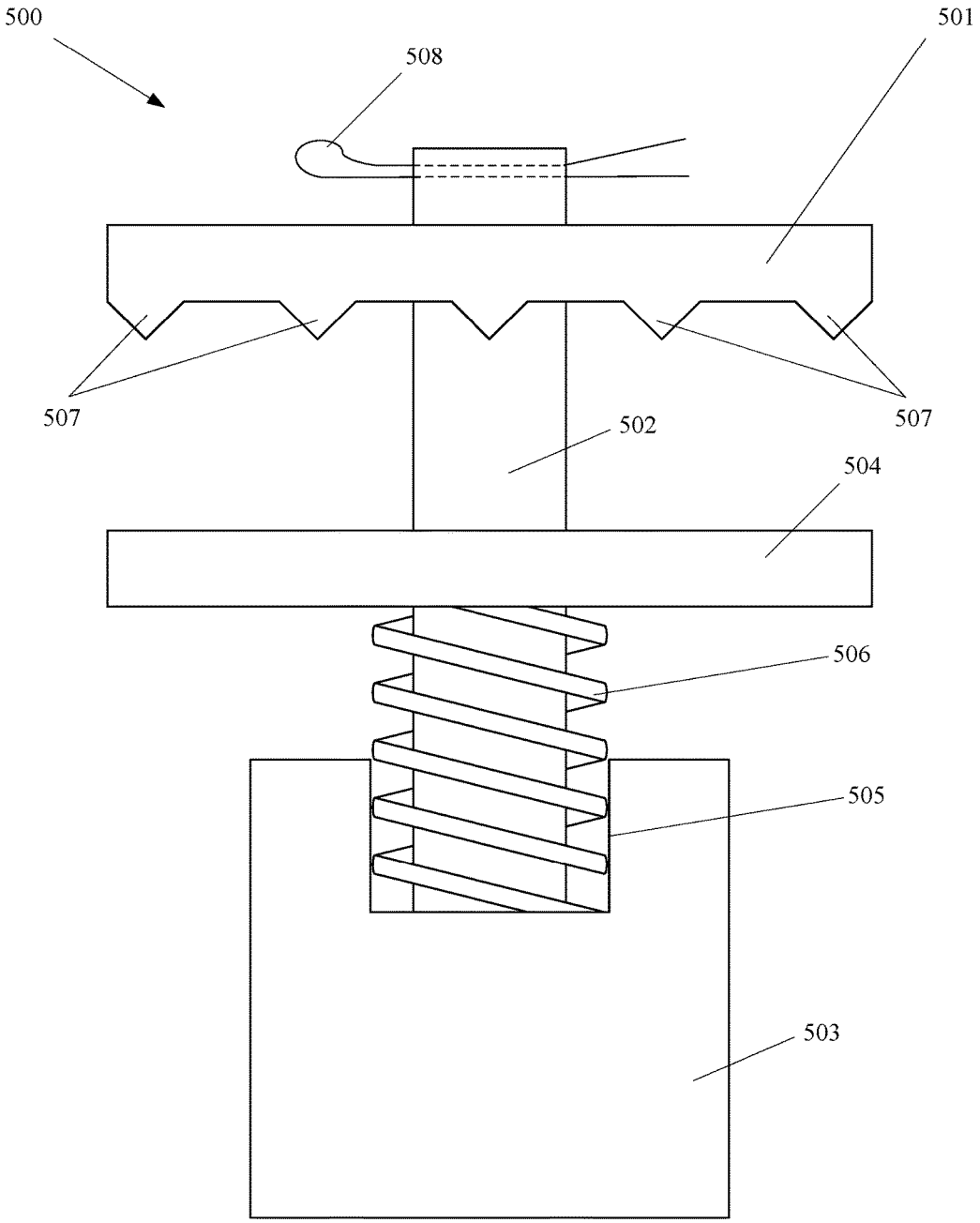
FIG. 4 is an isometric view of a connecting member according to an exemplary embodiment of the invention.

FIG. 4 is an isometric view of a connector member according to an exemplary embodiment of the invention. As shown in FIG. 4, a connect member 500 can have a head 501, a shaft 502, and a tightening member 503. The head 501 can have one or more locking structures 507. The shaft 502 can have a retention pin 508. The connector member can have a washer 504 and a spring 506. The tightening member 503 can have a recessed portion 505.

The shaft 502 can be threaded (not shown). The head 501 can have matching threads for receiving the threaded shaft 502. The head 501 can be sized in relative proportions to be slidably retained in a track (not shown). When the connector member 500 is slidably retained in a track, a user can slide the connector member 500 along the track to a desired position. Once in the desired position, a user can fix the connector member 500 in place by tightening the tightening member 503. The tightening member 503 can be fixed to the shaft 502. The tightening member 503 can be sufficiently sized to enable hand-tightening by a user without tools. The tightening member 503 can be knurled (not shown) for additional grip.

The head 501 can have locking structures 507. The locking structures 507 can be projections or bumps. The locking structures 507 can engage similar features in the slot of a track. The locking structures 507 can prevent the connector member 500 for inadvertently sliding along the slot in the track. A user can disengage the locking structures 507 by pushing loosening the tightening member 503 and then pushing upwards on the tightening member 503 to disengage the locking structures 507 from the slot. Although the locking structures 507 are depicted as five triangular projections from the head 501, other shapes, numbers and configurations of the locking structures 507 are contemplated by the invention. For example, a head could have just a single locking structure that engages a mating locking structure of the slot of the track. The locking structure could be a triangular projection as shown in FIG. 4, or could be cylinders, posts, or bumps. In the alternative, the locking structures could be depressions, notches, slots, or cut-aways from the head 501 that can be engaged by complimentary features in the slot of the track.

A washer 504 can be disposed on the shaft 502 of the connector member 500. When the connector member 500 is inserted into the slot of a track, the head 501 can be slidably retained inside the slot, while the washer 504 can be slidably disposed on an outside of the slot and the track. The washer 504 can distribute the force created by the tightening member 503 when it is fully tightened and prevent cosmetic damage to the track. The washer 504 can alternatively be sized to fit inside a slot of a track so that the force of the head 501 can be evenly distributed on undercut portions of the track. The washer 504 can optionally be replaced with part of an exercise accessory (see, e.g. FIG. 3). A spring 506 can be disposed on the shaft 502 between the tightening member 503 and the washer 504. The spring 506 can apply slight pressure to the washer 504 pushing it towards the head 501. This slight pressure can remove jiggle or play from the assembled connector member 500 and also keep the locking structures 507 engaged with the corresponding features of the track. The tightening member 503 can include a recessed portion 505 that is sized in approximate proportions to receive the spring 506 when the tightening member 503 is fully tightened. In this way, the spring 506 cannot be damaged the through over-tightening.

The shaft 502 can further include a pin 508 to prevent accidental removal of the threaded shaft 502 from the head 501. In embodiments of the invention where the shaft 502 is threaded into the head 501, a user, in loosening the assembled connector member 500 to remove it from a track or reposition it, could easily over-loosen the connector member 500 such that the shaft 502 is completely unscrewed from the head 501. To prevent accidental unscrewing, the pin 508 can stop the shaft 502 from passing through the head 501. Although the pin 508 is depicted as a simple cotter pin, other mechanisms to achieve this purpose are contemplated within the scope of this invention including other types and configurations of pins as well as retaining washers and locking washers.

In other embodiments of the invention, the head 501 can be welded to the shaft 502 or integrally formed with the shaft 502, such as from a single piece of material. In such embodiments, the pin 508 can be omitted and the tightening member 503 can be threaded to receive the shaft 502.

Figure 5A:
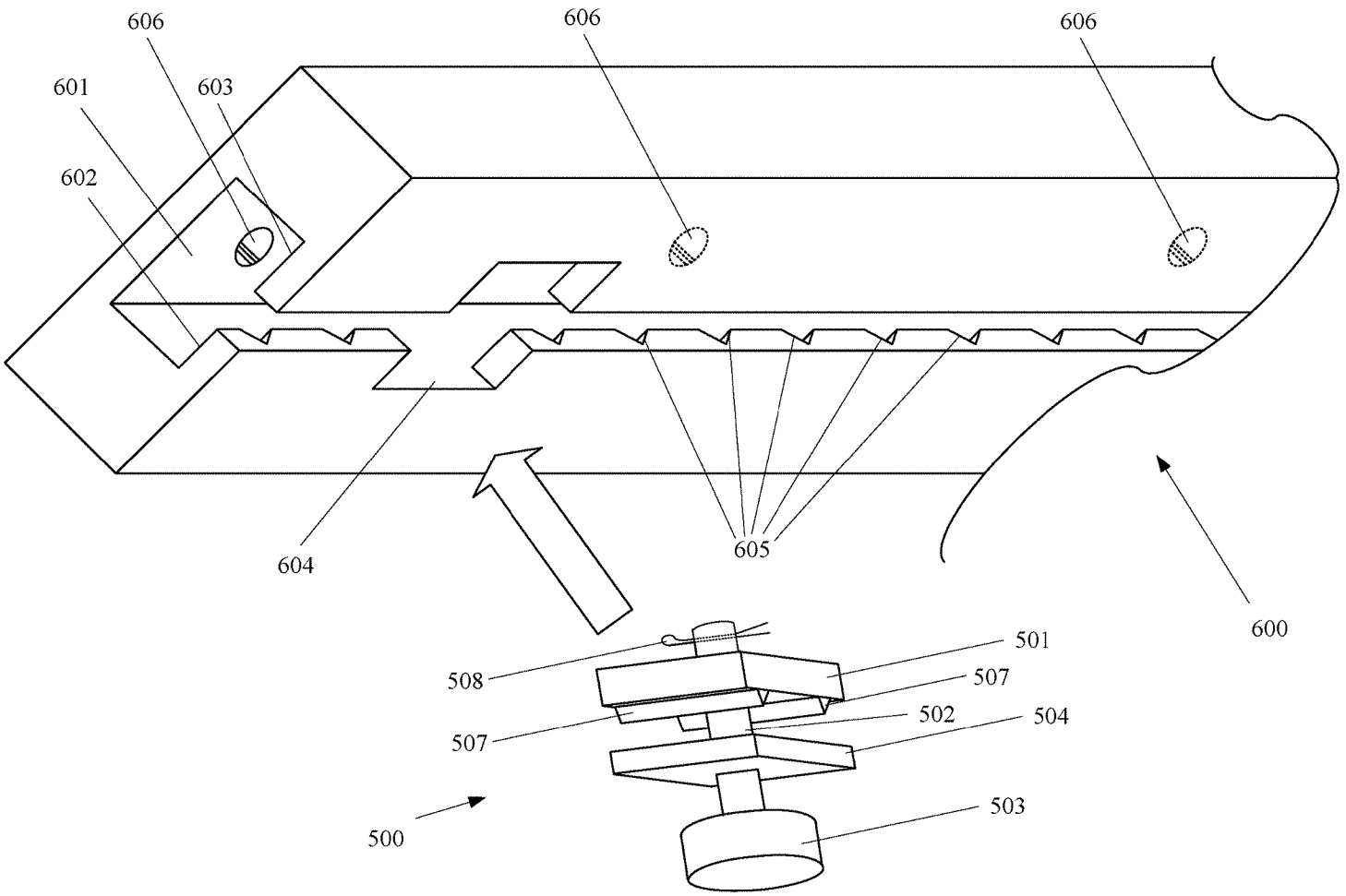
FIG. 5A is an isometric view of a body weight exercise device according to an exemplary embodiment of the invention.

FIG. 5A is an isometric view of a body weight exercise device according to an exemplary embodiment of the invention. As shown in FIG. 5A, a body weight exercise device includes a track 600 and a connector member 500. The track 600 includes a slot 601 having undercut portions 602 and 603. The undercut portions 602 and 603 can have locking structures 605. The slot 601 can have a cutout 604. The slot 601 can have one or more holes 606. The connector member 500 can have a head 501, a shaft 502, and a tightening member 503. The head can have locking structures 507. The shaft 502 can have a pin 508.

The head 501 of the connector member 500 can be sized in approximate proportions to be inserted into the slot 601 through the cutout 604. In this way, the track 600 can be sized to fit snugly into the inside of a door frame and the connector member 500 can easily be introduced into and slidably retained in the slot 601 of the track 600. Although the cutout 604 can receive the head 501 of the connector member 500, the head 501 of the connector member 500 can alternatively be received through an end of the track 600.

When the head 501 of the connector member 500 is inserted into the slot 601, the washer 504 can rest against the face of the track 600. The washer 504 can distribute the force created by the tightening member 503 and prevent cosmetic damage to the track 600.

The locking members 605 can be sized and located in approximate positions to engage with matching locking members 507. When the tightening member 503 is screwed down, the locking members 507 of the head 501 can engage the locking structures 605 of the undercut portions 602 and 603 of the slot 601 of the track 600. In cooperation, the locking structures 507 and 605 can prevent undesired sliding of the connector member 500 in the track 600. When the tightening member 503 is loosened, a user can push on the tightening member to disengage the locking structures 507 and 605 and slide the connector member 500 to a new position in the track 600. Although preferred embodiments have been shown and described with locking structures 507 and 605, such features are optional. In embodiments of the invention, simple friction between the head 501 and the undercut portions 602 and 603 of the slot 601 is sufficient to prevent unintended sliding.

In embodiments of the invention, the slot 601 is a T-slot having undercut portions 602 and 603. The these undercut portions 602 and 603 can slidably retain the head 501 of the connector member 501. The undercut portions 602 and 603 can have locking structures 605 that generally correspond in size and position to couple with the locking structures 507 of the head 501 of the connector member 500. In the illustration of FIG. 5A, only the undercut portion 602 is shown to have locking structures 605, however, those of skill in the art will appreciate that locking structures can be similarly located on the opposite undercut portion 603.

The slot 601 of the track 600 can include holes 606 in the bottom of the slot 601. The holes 606 can penetrate from the bottom of the slot 601 through to the other side of the track 600. The holes 606 can receive screws or bolts (not shown) for mounting the track 600 into a doorframe (not shown).

Figure 5B:
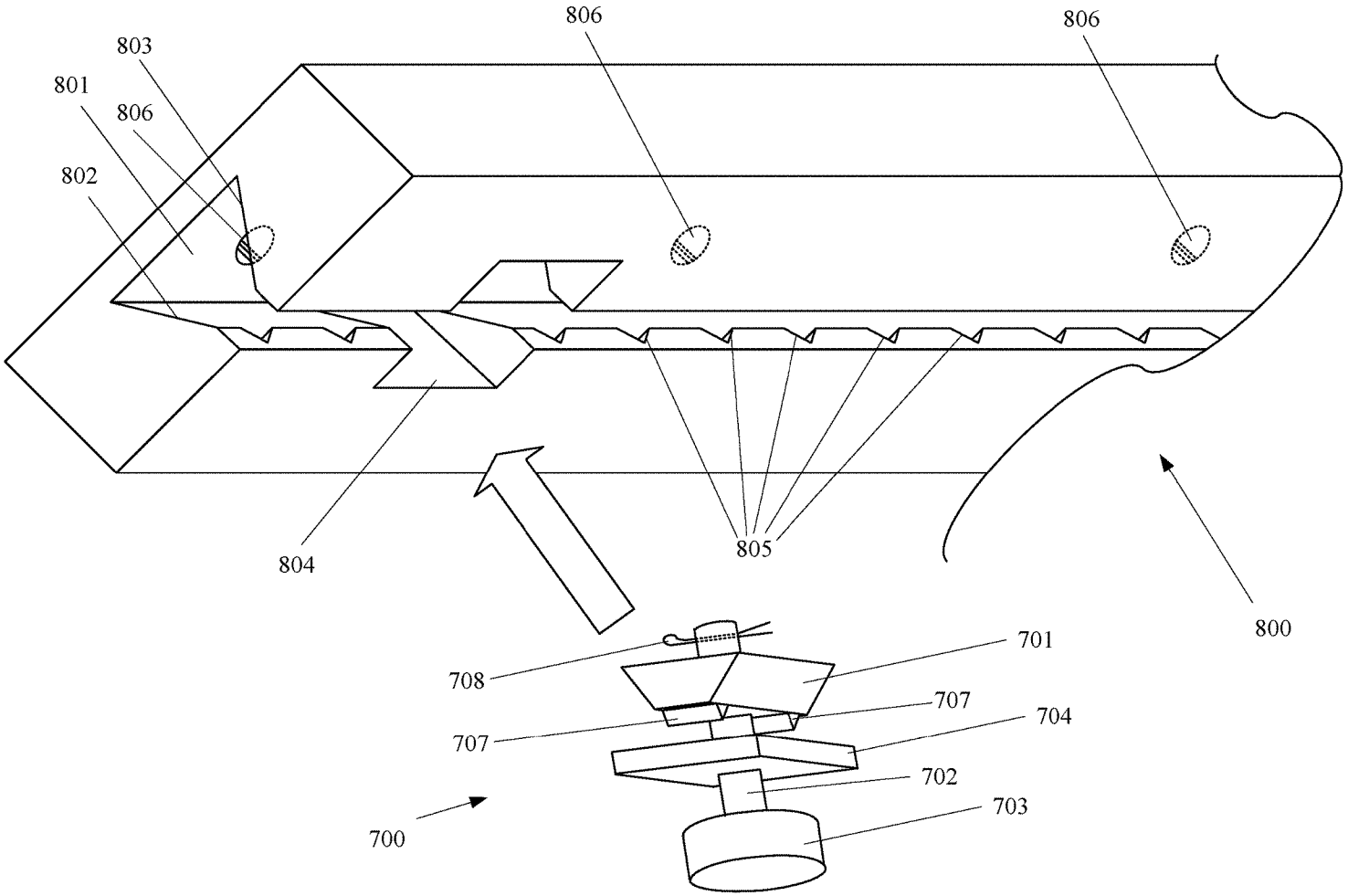
FIG. 5B is an isometric view of a body weight exercise device according to an exemplary embodiment of the invention.

FIG. 5B is an isometric view of a body weight exercise device according to an exemplary embodiment of the invention. As shown in FIG. 5B, a slot 801 of a track 800 can match the approximate shape of a head 701 of a connector member 700. The slot can have a cutout 804. The slot 801 can have undercut portions 802 and 803. The slot 801 can have holes 806 extending from the bottom of the slot 801 through to the other side of the track 800. The undercut portions 802 and 803 can have locking structures 805. The connector member 700 can have matching locking structures 707 on the underside of the head 701.

The connector member 700 can have a shaft 702. The shaft 702 can be threaded. A washer 704 can be disposed on the shaft 702. A tightening member 703 can be formed at one end of the shaft 703. The tightening member 703 can have gripping features on it to enable a user to tighten it by hand. The gripping features (not shown) can be knurling or geometry that gives a user additional friction when turning the tightening member. The shaft 702 can have a pin 708 to prevent a user from inadvertently unthreading the shaft 702 from the head 701.

A user can introduce or insert the head 701 of the connector member 700 into the cutout 804 of the track 800. The cutout 804 can have a similar profile or cross-section to that of the head 701 of the connector member 700. The slot 801 can have a similar profile or cross-section to that of the head 701 of the connector member 700. The head 701 can be slidably received in the slot 801 through the cutout 804 and then slidably retained in the slot by the undercut portions 802 and 803.

The locking structures 805 of the track 800 can receive matching or complimentary locking structures 707 on the head 701 of the connector member 700. Although the locking members 805 and 707 are shown as notches and protrusions (respectively), those of skill in the art would appreciate that features could be reversed such that the track 800 contained protrusions and the head 701 contained corresponding notches.

The washer 704 of the connector member 700 can be larger than the cutout 804 in the track 800. The washer 704 can slide on the outside of the track to distribute the force from the tightening member 703 and prevent cosmetic damage to the track 800. In embodiments of the invention, the washer 704 can be omitted and replaced instead with a portion of an exercise accessory (see, e.g. FIG. 3). In embodiments of the invention, an exercise accessory can be added to the connector member 700 on the shaft 702 on either side of the washer 504. Although the washer 504 is depicted as square in the illustration of FIG. 5A and FIG. 5B, the washer 504 is not limited to this shape and common round washers and other types of washers are contemplated and within the scope of the invention.

Although the embodiment of FIG. 5B is shown with locking features 805 and 707, embodiments of the invention are contemplated that omit these locking features. For example, in the context of FIG. 5B, the triangular and wedge-shaped profile of the slot 801 and the head 701 create a wedging force that will prevent the head from sliding in the track when a force (e.g. body weight) is applied to the connector member. In embodiments of the invention, the tightening member 503 and shaft 502 is an eye-bolt (not shown). A user can easily grasp and eye-bolt to tighten the connector member in a desired location in the track. Additionally, a user can easily clip a variety of accessories to an eye-bolt with a standard d-clip or carabiner. In embodiments of the invention, the washer is formed from rubber or has rubber on one side. The rubber of the washer can contact the face of the track 800 and when the connector member 700 is tightened, the connector member 700 can be held in place by friction created between the rubber portion of the washer 504 and the face of the track 800. Although embodiments of the invention describe the use of a rubber washer or a washer having rubber portions, other rubber and rubber-like materials are contemplated as substitutes for rubber or in combination with rubber, including, without limitation, latex and silicone.

Figure 6:
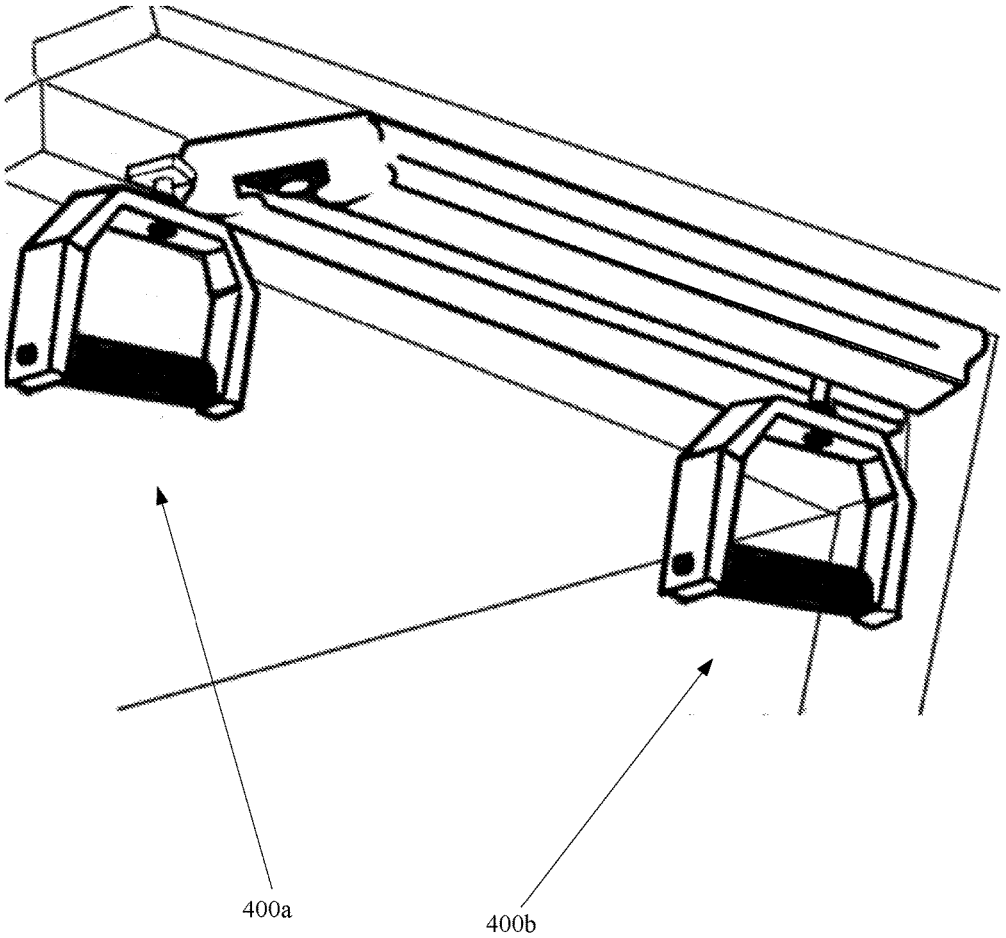
FIG. 6 is an isometric view of a body weight exercise device having handles according to an exemplary embodiment of the invention.

FIG. 6 is an isometric view of a body weight exercise device having handles according to an exemplary embodiment of the invention. As shown in FIG. 6, handles 400*a* and 400*b* can be used with the invention. Handles 400*a* and 400*b* can be used for pull-ups, chin-ups, or other exercises.

Figure 7:
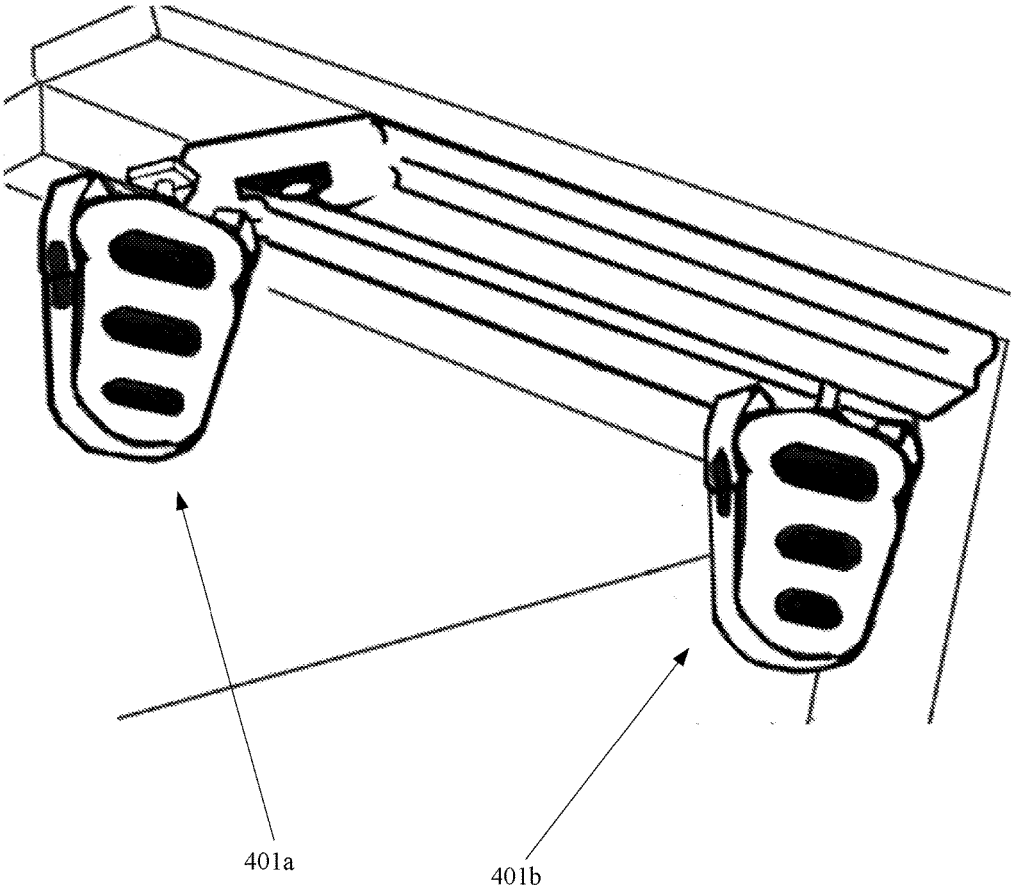
FIG. 7 is an isometric view of a body weight exercise device having finger grips according to an exemplary embodiment of the invention.

FIG. 7 is an isometric view of a body weight exercise device having finger grips according to an exemplary embodiment of the invention. As shown in FIG. 7, finger grip accessories 401*a* and 401*b* can be configured to be compatible with the track system. The finger grip accessories 401*a* and 401*b* can be used by rock climbers and can have shapes similar to hand holds used in indoor rock climbing. The finger grip accessories 401*a* and 401*b* can aid a user to exercise grip strength in the fingers.

Figure 8:
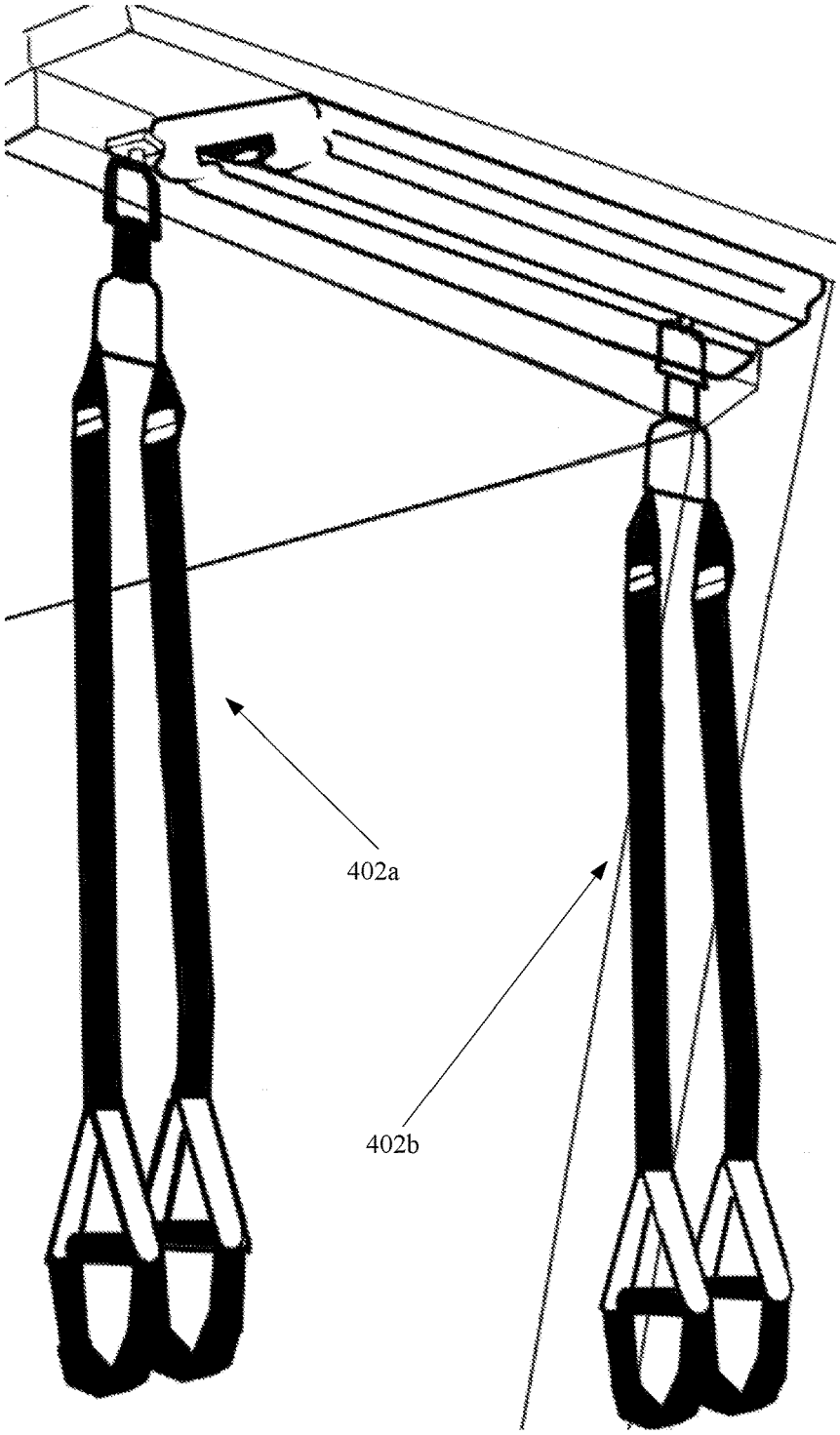
FIG. 8 is an isometric view of a body weight exercise device having inversion straps according to an exemplary embodiment of the invention.

FIG. 8 is an isometric view of a body weight exercise device having inversion straps according to an exemplary embodiment of the invention. As shown in FIG. 8, inversion straps 402*a* and 402*b* can be compatible with a track system. Inversion straps 402*a* and 402*b* can be grasped by a user and the user can then flip upside down. Alternatively, a user can grasp the handle portion of the inversion straps 402*a* and 402*b* and perform elevated pushups.

Figure 9:
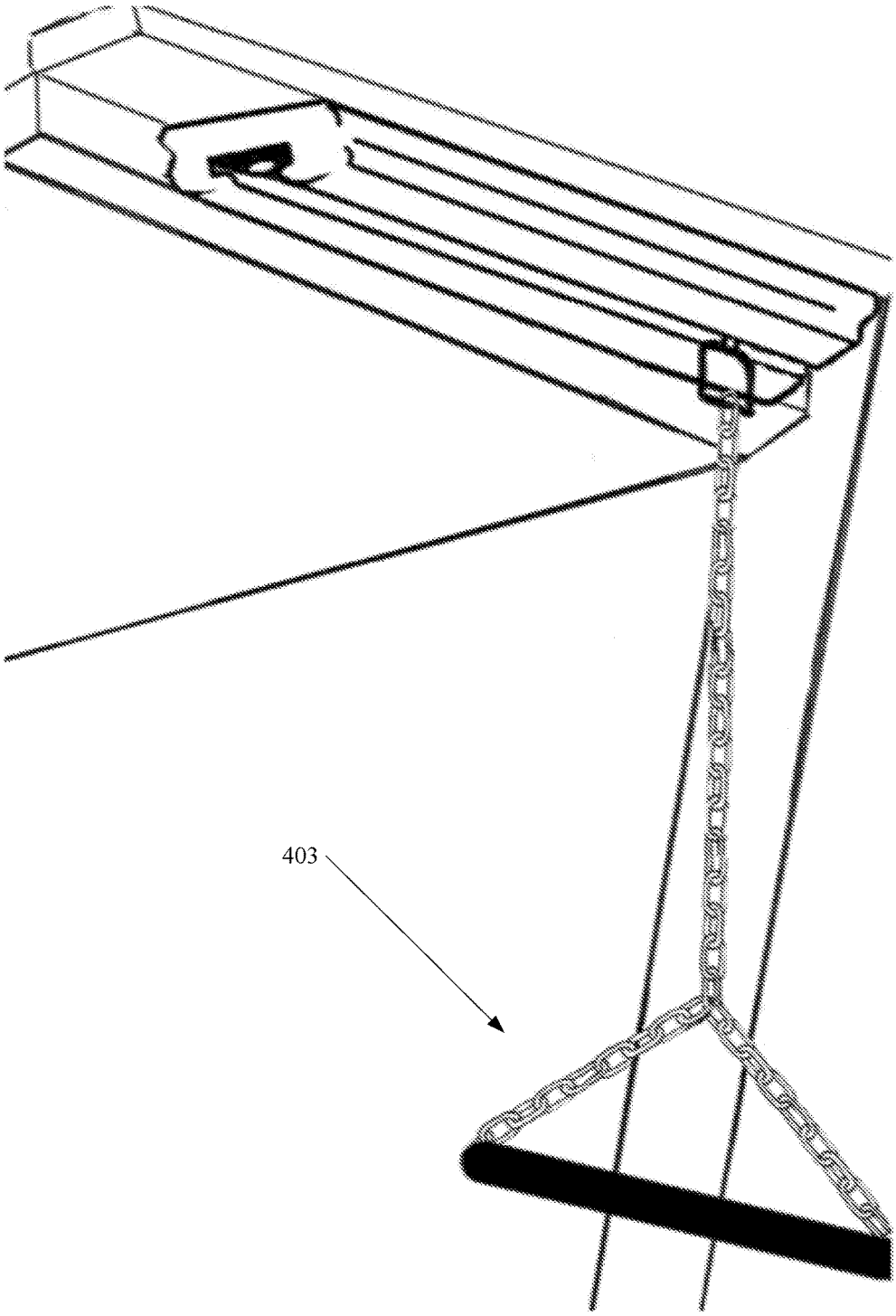
FIG. 9 is an isometric view of a body weight exercise device having a pull-up bar according to an exemplary embodiment of the invention.

FIG. 9 is an isometric view of a body weight exercise device having a pull-up bar according to an exemplary embodiment of the invention. As shown in FIG. 9, the pull-up bar 403 can be introduced into the track system. The pull-up bar 403 can be connected by a chain thereby making the pull-up bar 403 lower to the ground so that the exercise system can be used by children.

It will be apparent to those skilled in the art that various modifications and variations can be made in the body weight exercise assembly configured to accept various discipline attachments without departing from the spirit or scope of the invention. Thus, it is intended that embodiments of the invention cover the modifications and variations of this invention provided they come within the scope of the appended claims and their equivalents.

What is claimed is:

1. An exercise device, comprising:

an elongated body;

a slot formed length-wise in the body, the slot having an undercut portion on each side;

a plurality of holes in slot for receiving one of a plurality of fasteners;

an exercise accessory having a connecting member;

a head of the connecting member, the head sized to be received in the slot of the body and configured to be slidably retained in the slot;

a shaft connected to the head of the connecting member; and a tightening member disposed on the shaft of the connecting member, the tightening member configured to squeeze the undercut portions of the slot between the head of the connecting member and the tightening member.

2. The device of claim 1 further comprising a locking structure formed in the undercut portions of the slot.

3. The device of claim 2 further comprising a mating locking structure of the connecting member.

4. The device of claim 3 further comprising a recessed portion of the tightening member.

5. The device of claim 3 further comprising a spring on a shaft of the connecting member.

6. The device of claim 5 wherein the spring is disposed between the mating locking structure and the tightening member.

7. The device of claim 1 further comprising a cutout in the slot for receiving the head of the connecting member.

8. The device of claim 1 wherein the slot is a T-slot.

9. The device of claim 7 wherein the slot extends to a first and a second end of the body.

10. The device of claim 1 wherein body is formed from extruded aluminum.

11. The device of claim 1 further comprising a washer on the connecting member for distributing a force applied by the head of the connecting member to the slot.

* * * * *